US006953155B2

(12) United States Patent
Joseph et al.

(10) Patent No.: US 6,953,155 B2
(45) Date of Patent: Oct. 11, 2005

(54) PRESSURE ASSISTED LIQUID SUPPLY ASSEMBLY

(75) Inventors: Stephen C. P. Joseph, Nuneaton (GB); Gary Brotherton, Nuneaton (GB); Robert J. Rothrum, Coon Rapids, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/279,518

(22) Filed: Oct. 24, 2002

(65) Prior Publication Data

US 2004/0084553 A1 May 6, 2004

(51) Int. Cl.[7] ..... B05B 17/00; B05B 11/02; B05B 9/00

(52) U.S. Cl. ..... 239/1; 239/323; 239/328; 239/345; 239/346; 239/364; 239/379; 222/105; 222/107; 222/386.5

(58) Field of Search ..... 239/320, 323, 239/328, 345, 346, 375–379, 373, 364, 365, 367, 1; 222/92, 105, 107, 386.5

(56) References Cited

U.S. PATENT DOCUMENTS

| | | | | |
|---|---|---|---|---|
| 2,153,240 A | | 4/1939 | Dailey et al. | |
| 2,177,032 A | | 10/1939 | Baumgardner | |
| 3,198,438 A | * | 8/1965 | Hultgren et al. | 239/328 |
| 3,270,920 A | | 9/1966 | Nessler | |
| 4,043,510 A | | 8/1977 | Morris | |
| 4,928,859 A | | 5/1990 | Krahn et al. | |
| 5,054,687 A | * | 10/1991 | Burns et al. | 239/375 |
| 5,119,992 A | * | 6/1992 | Grime | 239/373 |
| 5,236,128 A | * | 8/1993 | Morita et al. | 239/365 |
| 5,415,352 A | * | 5/1995 | May | 239/365 |
| 5,611,485 A | * | 3/1997 | Davis | 239/364 |
| 2003/0006310 A1 | | 1/2003 | Rothrum et al. | |

FOREIGN PATENT DOCUMENTS

| | | |
|---|---|---|
| DE | 588 631 | 11/1933 |
| DE | 201 17 496 U1 | 2/2002 |
| JP | 11-347462 | 12/1999 |
| JP | 11 347462 | 12/1999 |
| JP | 2000-237641 | 9/2000 |
| KR | 2003-091487 | 12/2003 |
| WO | WO 98/32539 A1 | 7/1998 |
| WO | WO 01/12337 A1 | 2/2001 |

OTHER PUBLICATIONS

Lex–Aire 2002 HVLP Spray Gun, Lex–Aire Products, Inc., North Billerica, Massachusetts, [on line], [retrieved from the internet on Aug., 14, 2002], URL www. netshoppe.com/lexaire/2002/pro2000.html, pp. 1–2.

(Continued)

*Primary Examiner*—Steven J. Ganey
(74) *Attorney, Agent, or Firm*—William L. Huebsch

(57) ABSTRACT

An assembly for feeding liquid to the inlet port of a liquid spraying device or spray gun. The assembly includes a stiff container that defines an opening into a cavity in the container, and a flexible liner positioned within the cavity in the container has an outer surface generally corresponding in shape to the inner surface of the container, an inner surface defining a cavity in the liner, and an annular lip along the top end of the side wall defining an opening into the cavity in the liner. An included adapter assembly has a central portion with a through opening that is adapted to engage the inlet port of a liquid spraying device, a transverse portion including a peripheral part adapted for engagement within the flexible liner adjacent said top end of the container, and means for sealing the flexible liner around the peripheral part of the adapter assembly. An air supply assembly connected to the container supplies air at a relatively low pressure (e.g., in the range of about 0.5 to 8 pounds per square inch or 3.5 to 55 kilopascals) between the outer surface of the flexible liner and the inner surface of the container which improves the flow of liquids through the liquid spraying device or spray gun to which the assembly is attached, and allows that spraying device or spray gun to be used in any orientation.

19 Claims, 4 Drawing Sheets

OTHER PUBLICATIONS

"HVLP Pro Upgrade For Your Sata NR–95 NR–92 or Jet B Spray Gun", HVLP–Pro Upgrade For Your Sata NR–95 Spray Gun [on line], [retrieved from the internet on Aug., 14, 2002], URL www.netshoppe.com/sataupgrade/, pp. 1–3.

HVLP–Pro Upgrade Eliminates Fan Fade Out [on line], [retrieved from the internet on Aug., 14, 2002], URL www.netshoppe.com/sataupgrade/nofade.html?mgiToken=CDA00E16CC09B6B4E, p. 1.

¼" Air Line Is All You Need [on line], [retrieved from the internet on Aug., 14, 2002], URL www.netshoppe.com/sataupgrade/airhose.html?mgiToken=CDA00E16CC09B6B4E, p. 1.

"Leak–Proof Floating Gasket Plate", The Amazing Floating Gasket Plate [on line], [retrieved from the internet on Aug., 14, 2002], URL www.netshoppe.com/sataupgrade/gasket-plate.html?mgiToken=CDA00E16CC09B6B4E, p. 1.

3M™ Paint Preparation System, Product Brochure #60–4400–7668–9(516)JR, 3M Automotive Aftermarket Division, St. Paul, Minnesota.

* cited by examiner

PRESSURE ASSISTED LIQUID SUPPLY ASSEMBLY

FIELD OF THE INVENTION

The present invention relates to the liquid supply assemblies that supply liquids to be sprayed (e.g., paint) to liquid spraying devices such as spray guns, and in one aspect, to such liquid supply assemblies in which the liquids are supplied to the liquid spraying devices or spray guns from within collapsible liners.

BACKGROUND OF THE INVENTION

Various gravity feed liquid supply assemblies have been used for supplying liquids to be sprayed to liquid (e.g., paint) spraying devices such as spray guns, including the liquid supply assembly including a collapsible liner that is described in International Publication Number WO 98/32539 (Joseph) of Jul. 30, 1998, the content whereof is incorporated herein by reference. That liquid supply assembly described in WO 98/32539 includes a container of stiff polymeric material comprising a generally cylindrical side wall and a bottom wall at a bottom end of the side wall with an opposite top end of the side wall defining an opening into a cavity in the container, and a flexible liner within that cavity. That liner corresponds in shape to an inner surface of the container, and has an annular lip along the top end of the side wall that defines an opening into a cavity in the liner. That liquid supply assembly further includes an adapter assembly comprising a central portion having a through opening that is adapted to engage the inlet port of the gravity fed liquid spraying device, a transverse portion including a peripheral part adapted for engagement within the flexible liner adjacent the top end of the container, and means for releasably securing the flexible liner around that peripheral part of the adapter assembly. The flexible liner within the cavity in the container can be used as a receptacle for measuring and/or mixing liquids to be sprayed, and markings or indicia are provided along the side of the container that enable the volume of the contents of the container to be determined, and can facilitate measuring liquid components. After the liquid is in the liner the adapter assembly is engaged with and secured to the flexible liner adjacent the top end of the container, and is engaged with the inlet port of a spraying device or spray gun. When the spray gun is operated with the container above the spray gun, both pressure from the fluid column in the container and suction from a venturi in the spray gun will cause liquid from the liner to enter the spray gun, whereupon the liner will collapse and decrease in volume to just contain the amount of liquid remaining in the liner. When the spray gun is positioned with the container below the spray gun (as can be desirable, for example to spray the underside of a structure), the fluid column in the liner can cause a negative pressure at the inlet to the spray gun. Most spray guns produce enough suction to overcome that negative pressure and withdraw sufficient liquid from the liner in a filled container that has a capacity of about 20 ounces or 600 milliliter to provide a useful spray pattern. When the filled container has a capacity of a significantly larger size such as about 32 ounces or 950 milliliters, however, the negative pressure at the inlet of the spray gun when the spray gun is operated with the container below the spray gun will can have a noticeable negative effect on the spray pattern produced by the spraying device compared to the spray pattern produced when the container is positioned above the spray gun.

Other types of gravity feed liquid supply assemblies that have been used for supplying mixtures of component liquids to be sprayed to liquid (e.g., paint) spraying devices or spray guns include the type of liquid supply assembly used on the "SATA" (t.m.) NR-95,NR-92, or Jet B Spray guns commercially available from Sata, Farbspritzechnik GmbH & Co., Kornwestheim, Germany, modified to include a HVLP (i.e., high volume, low pressure) Pro Upgrade Kit available from Lex-Aire Products, Inc., North Billerica, Mass.; the type of liquid supply assembly used on the "LEX-AIRE" (t.m.) 2002 HVLP spray gun commercially available from Lex-aire Products, Inc., North Billerica, Mass.; and the type of liquid supply assembly used on the "GRACO" (t.m.) Turbine HVLP 4900 Fine Finish Sprayer commercially available from Graco, Inc., Minneapolis, Minn. Those liquid supply assemblies include a container of stiff polymeric material comprising a generally cylindrical side wall and a generally conical bottom wall at a bottom end of the side wall with an opposite top end of the side wall defining an opening into a cavity in the container. An adapter connects a through opening in the bottom wall to an inlet port of the gravity fed liquid spraying device. Liquids to be sprayed are poured into the cavity, and a liquid and air tight cap is attached to the top end of the side wall. As the liquids are sprayed low pressure air (e.g., in the range of about 0.5 to 8 pounds per square inch or 3.5 to 55 kilopascals) is supplied to the cavity through an air supply line having one end extending through the cap, and its opposite end engaged with a supply of that low pressure air developed in the spray gun (e.g., from the supply of air used to shape the spray stream) when the spray gun is being operated to spray the liquid from the container. This low pressure in the cavity of the container is said to provide certain advantages including finer atomization and a faster —14 inch (35.6 cm) wide fan pattern. Liquid supply assemblies of this type, however, can only be used with the top end of the container generally uppermost, for if the container is tipped very far from that position, the liquid column that feeds liquid into the spray gun can be lost, and liquid can enter the air supply line causing it to plug, and/or liquid to flow through it into parts of the spray gun where it will cause operational or cleaning problems.

DISCLOSURE OF THE INVENTION

The present invention provides a liquid supply assembly for use with liquid spraying devices such as spray guns that, like the liquid supply assembly described above with reference to International Publication Number WO 98/32539, supplies liquid to the liquid spraying device from a collapsible liner, but which can significantly improve the operation and/or versatility of the liquid spraying device to which it is attached, particularly when the liquid container in that supply assembly has a capacity significantly over 20 ounces or 600 milliliters.

According to the present invention there is provided a liquid supply assembly that, like the liquid supply assembly described in International Publication Number WO 98/32539, comprises (1) a container of stiff polymeric material comprising a generally cylindrical side wall, and a bottom wall extending across the bottom end of the side wall, the container having an inner surface defining a cavity in the container, and a top end of the side wall defining an opening into the cavity; (2) a flexible liner within the cavity in the container, which liner has an outer surface corresponding in shape to the inner surface of the container, an inner surface defining a cavity in the liner, and an annular lip along the top end of the side wall defining an opening into the cavity in the liner; and (3) an adapter assembly that comprises a central portion having a through opening that is adapted to engage the fluid inlet port of the liquid spraying device, a transverse portion including a peripheral part adapted for engagement within the flexible liner adjacent the top end of the container, and means for releasably securing the flexible liner around that peripheral part of the adapter assembly.

Unlike the liquid supply assembly described in International Publication Number WO 98/32539, however, the liquid supply assembly according to the present invention further includes an air supply assembly connected to the container for supplying air at a relatively low pressure (e.g., under about 10 pounds per square inch or 69 kilopascals) above atmospheric pressure between the outer surface of the flexible liner and the inner surface of the container.

Providing air at a relatively low pressure above atmospheric pressure between the outer surface of the flexible liner and the inner surface of the container can provide several advantages, particularly including providing a much more stable and uniform spray pattern from the liquid spraying device or spray gun to which the liquid supply assembly is attached compared to use of the spraying device without providing such air pressure when the container and liner have capacities significantly exceeding 20 ounces or 600 milliliters (e.g., 32 ounces or 950 milliliters) and the spray gun is oriented in various positions, including positions with the liquid supply assembly above and below the spray gun.

Apparently, providing that air pressure between the outer surface of the flexible liner and the inner surface of the container sufficiently offsets some of the negative pressure effect at the inlet to the spray gun from having the fluid column in the liner below the spray gun to maintain that stable and uniform spray pattern.

Thus, a spray gun can be used with the liquid supply assembly mounted on it that has about as large a capacity as can easily be easily manually manipulated by most operators (i.e., somewhere around 32 ounces or 950 milliliters), while the spray gun can be positioned with the container either above or below the spray gun (as can be desirable, for example to spray the underside of a structure) without significantly changing the stability and uniformity of the spray patter produced by the spray gun.

Additionally, regardless of the size of the liner and container, such air pressure between the outer surface of the flexible liner and the inner surface of the container provides the ability to spray materials of higher viscosities through conventional spray guns than can be sprayed without the application of such air pressure; the ability to filter liquid such as paint through a finer filter medium (e.g., less than 125 microns or micrometers) than can be used for the same liquid without the application of such pressure because of the increased pressure drop across the filter; and the ability to expel a larger percentage of the liquid from within the liner. Relatively low air pressures (e.g., generally in the range of about 0.5 to 8 pounds per square inch or 3.5 to 55 kilopascals) between the outer surface of the flexible liner and the inner surface of the container can provide these advantages.

The air at a relatively low pressure above atmospheric pressure between the outer surface of the flexible liner and the inner surface of the container can be provided through a separate air pressure regulator from the same source of regulated air pressure used to operate the spraying device or from another source, or can be provided from the same sources of low pressure air on the spraying devices described above from which air pressure is supplied to their containers.

BRIEF DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
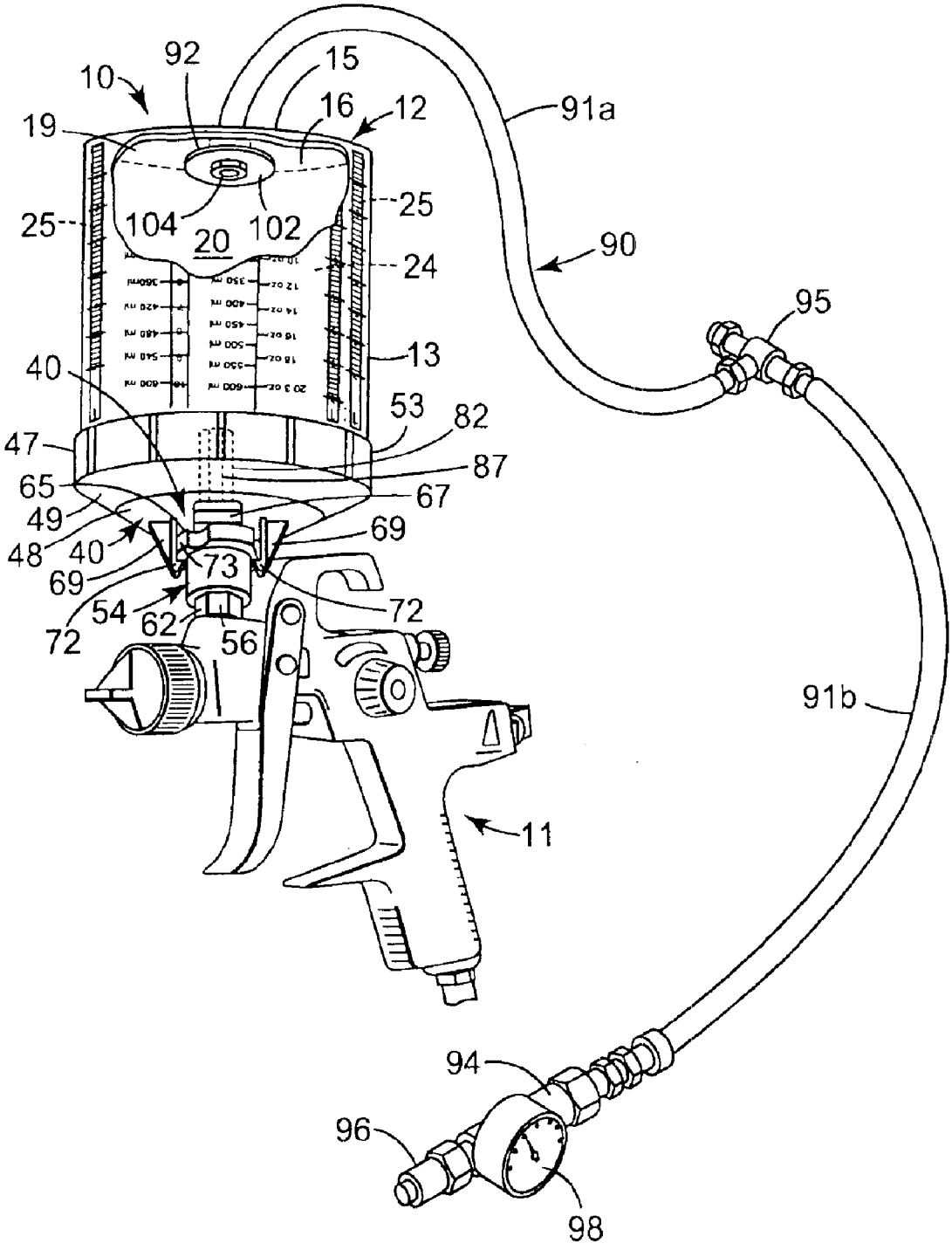
FIG. 1 is a perspective view of a liquid supply assembly according to the present invention, having a part broken away to show detail, that is shown attached to a spraying device or spray gun powered by a conventional compressed air source.
Figure 2:
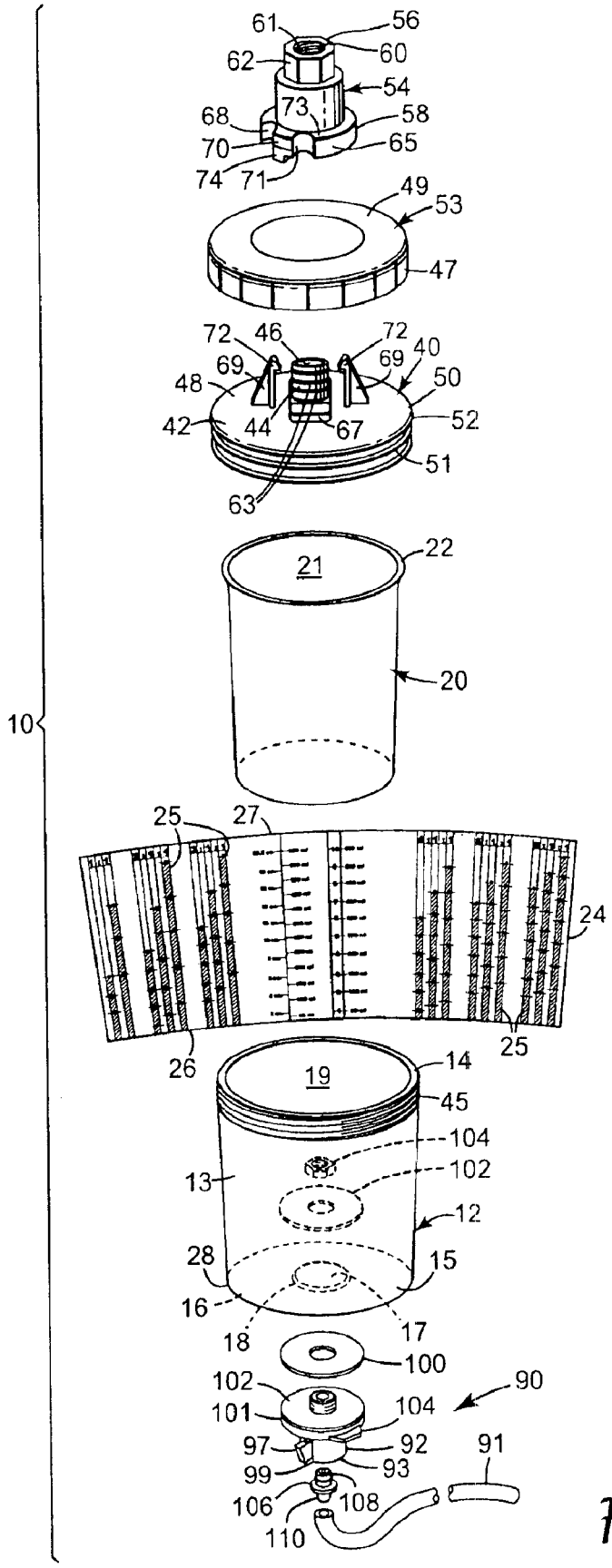
FIG. 2 is an exploded perspective view of the liquid supply assembly according to the present invention shown in FIG. 1.

Referring now to FIGS. 1 and 2 of the drawing there is illustrated a liquid supply assembly according to the present invention generally designated by the reference numeral 10. As is illustrated in FIG. 1, that liquid supply assembly 10 can be used to supply liquid to be sprayed to a conventional gravity fed liquid spraying device or spray gun 11 such as the spray gun 11 illustrated that is commercially designated a "SATA" (t.m.) NR-95" spray gun and is commercially available from Sata, Farbspritzechnik GmbH & Co., Kornwestheim, Germany).

The liquid supply assembly 10 includes a container 12 of stiff visually transparent polymeric material (e.g., injection molded of clarified polypropylene to have about 0.047 inch or 1.2 mm thick walls). The container 12 comprises a generally cylindrical side wall 13 having top and bottom ends 14 and 15, and a bottom wall 16 extending across the bottom end 15 of the side wall 13. The bottom wall 16 has a central circular through opening 17 around which extends an annular ridge 18. The top end 14 of the side wall 13 defines an opening into a cavity in the container 12 defined by its inner surface 19.

The liquid supply assembly 10 further includes a stiff but thin and flexible visually transparent liquid impervious collapsible cup-like liner 20 adapted to be positioned within the cavity in the container 12 (e.g., vacuum formed from a sheet of low density polyethylene to have a side wall about 0.004 to 0.01 inch or 0.1 to 0.25 mm thick and a bottom wall about 0.001 inch or 0.25 mm thick or thicker so that the bottom wall tends to stay generally planer as the side wall collapses), which liner 20 has side and bottom walls providing an outer surface that corresponds in shape to the inner surface 19 of the container 12, an inner surface 21 defining a cavity in the liner 20, and an annular radially outwardly projecting lip or flange 22 along the top end 14 of the side wall 13 defining an opening into the cavity in the liner 20. The liner 20 and the container 12 can be made in various sizes such as 600 milliliters (20.3 ounces) or 950 milliliters (32.1 ounces).

Optionally, as is more fully described in U.S. patent application Ser. No. 10/118,144 filed Apr. 9, 2002 (the content whereof is incorporated by reference herein), a portion of the inner surface 19 of the container 12 along the side wall 13 can have the shape of a conical frustum, and the liquid supply assembly 10 can also include a flexible polymeric indicating sheet 24 having indicia 25 printed on it which can be resiliently curved to be positioned in and conform to the frusto conical shape of the inner surface 19 of the container 12 along its side wall 13. Depending on how the indicating sheet 24 is thus positioned, the indicia 25 will either be visible and readable through the visually transparent side wall 13 of the container 12 to indicate the levels to which a plurality of different component liquids can be sequentially poured into the cavity 21 in the flexible liner 20 (when the liner is also within the container 12) to achieve different predetermined ratios between the component liquids; or the indicia 25 will be readable looking down through the opening into the cavity in the liner 20 defined by the top end 14 of the side wall 13 to determine the liquid level in the liner 20 which provides the advantage when transparent liquids are being measured that, because of indexes of refraction, the indicia 25 on the indicating sheet 24 below the level of liquid in the liner 20 will visually disappear to help determine that liquid level.

The liquid supply assembly 10 also includes a first adapter 40, preferably molded of polymeric material (e.g., polyethylene). The first adapter 40 comprises a central generally cylindrical portion 44 having a through opening 46 and a transverse portion 48 including a peripheral part 50. The peripheral part 50 of the transverse portion 48 includes a cylindrical axial projection 51 having ridges around its outer surface that fits closely within a portion of the flexible liner 20 adjacent its lip 22, and has a radially projecting flange 52 that, when the axial projection 51 is within the liner 20 and the liner 20 is within the container 12, is positioned along the side of the lip 22 on the liner 20 opposite the top end 14 of the container 12.

The liquid supply assembly 10 also includes a securing ring 53 having a central opening through which the central part of first adapter 40 can project, a generally radially inwardly projecting portion 49 shaped to overlay and contact the radially projecting flange 52 along the outer surface of the first adapter 40, and an axially projecting portion 47 having square threads along its inner surface. Those square threads on the securing ring 53 can be engaged with mating threads 45 around the outer surface of the container 12 adjacent its top end 14 to clamp the portion 49 of the ring 53 against the outer surface of the transverse portion 48 and thereby secure the lip 22 of the liner 20 between the container 12 and the first adapter 40 to releasably attach the first adapter 40 to the end of the liner 20.

A second adapter 54, also included in the liquid supply assembly 10, is preferably of metal (e.g., aluminum or stainless steel), has first and second spaced end portions 56 and 58, and has a through opening 60 extending through those end portions 56 and 58. The first end portion 56 of the second adapter 54 has internal threads 61 and six flatted wrench engageable surface portions 62 around its periphery, thereby being adapted to be releasably engaged with external threads on the inlet port of the gravity feed spray gun 11. Instead of internal threads 61, the first end portion 56 could alternatively, have any shape needed to properly engage a spray gun, such as external threads (not shown). The first adapter 40 and the second end portion 58 of the second adapter 54 have connector parts that are adapted for releasable liquid tight engagement with their through openings 46 and 60 in communication. Those connector parts include axially spaced radially outwardly projecting sealing rings 63 along the outer surface of the cylindrical portion 44 of the first adapter 40, and a cylindrical inner surface of the second adapter 54 that defines a portion of the through opening 60 in the second end portion of the second adapter 54. That cylindrical portion of the through opening 60 is adapted to receive the cylindrical portion 44 of the of the first adapter 40 in an engaged position with the sealing rings 63 in slightly compressed liquid tight engagement with the cylindrical portion of the through opening 60 and with an end surface on a collar 65 around the second end portion 58 of the second adapter 54 abutting a boss 67 on the first adapter 40 around the cylindrical portion 44. The collar 65 has major cylindrically concave recesses 68 along opposite sides of its periphery adapted to pass the distal ends of hook members 69 projecting from the transverse portion 48 of the first adapter 40 on opposite sides of the cylindrical portion 44 when the cylindrical portion 44 is pressed axially into the cylindrical portion of the through opening 60 with the first and second adapters 40 and 54 in a first relative position at which the hook members 69 are aligned with the major recesses 68 in the collar 65. The first and second adapters 40 and 54 can then be rotated relative to each other to a second relative position to cause the resiliently flexible projecting hook members 69 to be deflected outwardly by, and to move around, cylindrically convex cam lobes 70 projecting radially outwardly on corresponding sides of the major recesses 68 until the projecting hook members 69 are positioned in minor cylindrically concave recesses 71 in the collar 65 at which opposed inwardly projecting lips 72 on the distal ends of the projecting hook members 69 are engaged over a surface 73 of the collar 65 adjacent the first end 56 of the second adapter 54.

The combination 10 can also include a removable filter assembly 82 (see FIG. 1) of a known commercially available type (e.g., the filter assembly commercially available from Filtertek, Hebron, Ill.). The filter assembly 82 includes a stiff polymeric frame comprising a cylindrical outlet portion having a cylindrical outer surface frictionally engaged within the inner surface defining the through opening 46 in the central portion 44, which outlet portion has a through opening. The frame of the filter assembly 82 further includes an inlet portion projecting from the inner surface of the transverse portion 48 of the first adapter 40. The inlet portion has four axially extending rectangular inlet passageways 87 spaced around its periphery that communicate with the through opening in the outlet portion, and includes a filter screen extending across the inner ends of those inlet passageways 87. With the improved liquid supply assembly 10 according to the present invention that filter screen for use to filter automotive paint can be less than 125 microns or micrometers because of the increased pressure drop provided by the assembly 10 across the filter assembly 82. The use of such smaller size filter screen may give rise to the need for a filter assembly with increased filter screen area because of the amount of particles it will filter out of liquid from the liquid supply assembly 10.

The combination of the container 12, the liner 20, the indicating sheet 24, the first adapter 40, the securing ring 53, the second adapter 54, and filter assembly 82 described above are all presently commercially available under the trade designation 3M (t.m.) Paint Preparation System, from 3M Company, St. Paul, Minn.

The improved liquid supply assembly 10 according to the present invention further includes an air supply assembly 90 connected to the container 12 for supplying air at a predetermined pressure between the outer surface of the flexible liner 20 and the inner surface 19 of the container 12. That air supply assembly 90 includes a first length of flexible air line 91*a* having one end coupled to the inlet end of an air inlet connector assembly 92 having a first portion 93 sealed to the bottom wall 16 and extending through the opening 17 in the bottom wall 16, which connector assembly 92 has an outlet opening in the cavity of the container 12. The opposite end of the first air line 91*a* is coupled through an adjustable pressure relief valve 95 (see FIG. 1) to an end of a second length 91*b* of flexible air line that has its opposite end coupled to the outlet port of a conventional pressure regulator 94 by which a source of high pressure air coupled to an inlet port 96 of the regulator 94 can be reduced to a desired pressure indicated by a pressure gauge 98 on the regulator 94. That source of high pressure air could be from a separate air line, or can preferably be from the same source of air pressure provided for the spray gun 11 through the bottom end of a handle for the spray gun 11, with the pressure regulator 94 attached at and supported from that bottom end of the handle for the spray gun 11.

The first portion 93 of the air inlet connector assembly 92 has a threaded periphery and is sealed to the bottom wall 16 of the container 12 by a large circular rubber gasket 100 (e.g., 0.12 inch or 0.3 cm thick) extending around that periphery and along the outer surface of the bottom wall 16, two large steel washers 102, one along the inner surface of the bottom wall 16, and the other on the side of the gasket 100 opposite the bottom wall 16, and two nuts 104 in threaded engagement with the periphery of the portion 93 that are tightened to press the washers 102 together and thereby the gasket 100 into sealing engagement against the ridge 18 on the bottom wall 16 and against the portion 93. The air inlet connector assembly 92 also includes a second portion 106 that has an O-ring around a cylindrical portion 108 of its periphery that can be received in air tight engagement in a bore in the first portion 93 and can be releasably retained therein by a latch 97 that is similar to the latch 78 described in U.S. Pat. No. 4,928,859 (Krahn et al.), the content of which patent relating to the latch 78 is incorporated herein by reference. The latch 97 includes a plate 99 mounted to slide transversely on the first portion 93. The plate 99 has an opening that, in a release position of the plate 99, will allow the cylindrical portion 108 to move into or be removed from the bore in the first portion 93. In a latched position of the plate 99 (to which latched position the plate 99 is biased by a spring 101) the plate 99 will engage a groove around the cylindrical portion 108 to retain it in the bore in the first portion 93. Retaining means in the latch described in U.S. Pat. No. 4,928,859 retains the plate 99 in its release position at which the opening in the plate is aligned with the bore in the first portion 93 when the cylindrical portion 108 is not in that bore. When the cylindrical portion 108 is inserted into the bore that retaining means is released and the plate 99 will move to its latched position under the influence of the spring 101. The plate 99 can subsequently be returned to its release position by pressing on a tab 103 on one side of the plate 99. Thus the second portion 106 of the air inlet connector assembly 92 can either be engaged with its first portion 93 by inserting the cylindrical portion 108 into the bore, or can be released from its first portion 93 by pressing on the tab 103, either of which operations can be done using only one hand. A hose barbed end portion 110 of that second portion 106 opposite its cylindrical portion 108 is in sealing engagement with the inner surface of the first length of air line 91*a*. The air inlet connector assembly 92 made either of metal or polymeric material is commercially available from Colder Products Co., St. Paul, Minn.

A method according to the present invention for spraying liquids from the gravity fed liquid spraying device 11 includes (if the indicating sheet 24 is used) properly positioning the indicating sheet 24 along the inner surface of the side wall 13 of the container 12, sequentially pouring one or more liquids into the cavity in the liner 20 to levels indicated by the indicia 25 on the indicating sheet 24, and (if necessary) mixing the liquids in the liner 20. The cylindrical axial projection 51 of the first adapter 40 is then inserted into the portion of the flexible liner 20 adjacent its lip 22 until the radially projecting flange 52 is positioned along the side of the lip 22 on the liner 20 opposite the top end 14 of the container 12. The inner threads on the axially projecting portion 47 of the ring 53 are then engaged with the threads 45 around the container 12 so that the portion 49 of the ring 53 is clamped against the transverse portion 48 of the first adapter 40 to secure the lip 22 of the liner 20 between the container 12 and the first adapter 40 and thereby secure the first adapter 40 to the end of the liner 20.

The releasably engageable parts of the first and second adapters 40 and 54 are engaged as described above, and the first and second portions 93 and 106 of the air inlet connector assembly 92 are engaged (this being done with the spraying device 11 inverted). Air pressure the range of about 0.5 to 5 pounds per square inch or 3.5 to 35 kilopascals (e.g., 2 pounds per square inch or 14 kilopascals) is applied between the outer surface of the flexible liner 20 and the inner surface 19 of the container 12 through the pressure regulator 94, the flexible air lines 91*a* and 91*b*, and the air inlet assembly 92. The spray gun 11 is then activated while inverted to cause any air in the flexible liner 20 to be expelled through the spraying device 11, after which liquid in the liner 20 will be fed to the spray gun 11 through the filter assembly 82 and the openings 46 and 60 in the adapters 40 and 54, while the liner 20 collapses as that liquid is sprayed out. The use of the liner 20 and the air pressure applied between the outer surface of the flexible liner 20 and the inner surface 19 of the container 12 will allow the spray gun 11 to be oriented in any position with the container 12 above or below the spray gun 11 (as may be desirable, for example, to spray recessed upper surfaces of structures), even when the liner 20 and container 12 have a capacity of at least 950 milliliters or 32.1 ounces and are filled with liquid, while still providing a sustained, useful, generally stable and uniform spray pattern and without causing any operational problems.

After the desired amount of liquid is sprayed out, the parts of the first and second adapters 40 and 54 and the first and second portions 93 and 106 of the air inlet connector assembly 92 are disengaged. The first adapter 40 and the collapsed liner 20 (i.e., the side wall of the liner 20 will have collapsed axially while its end wall will have remained generally circular) with any remaining liquid in the collapsed liner 20 can be removed from the container 12 and discarded, leaving only the second adapter 54 and the spray gun 11 that need to be cleaned.

Figure 3:
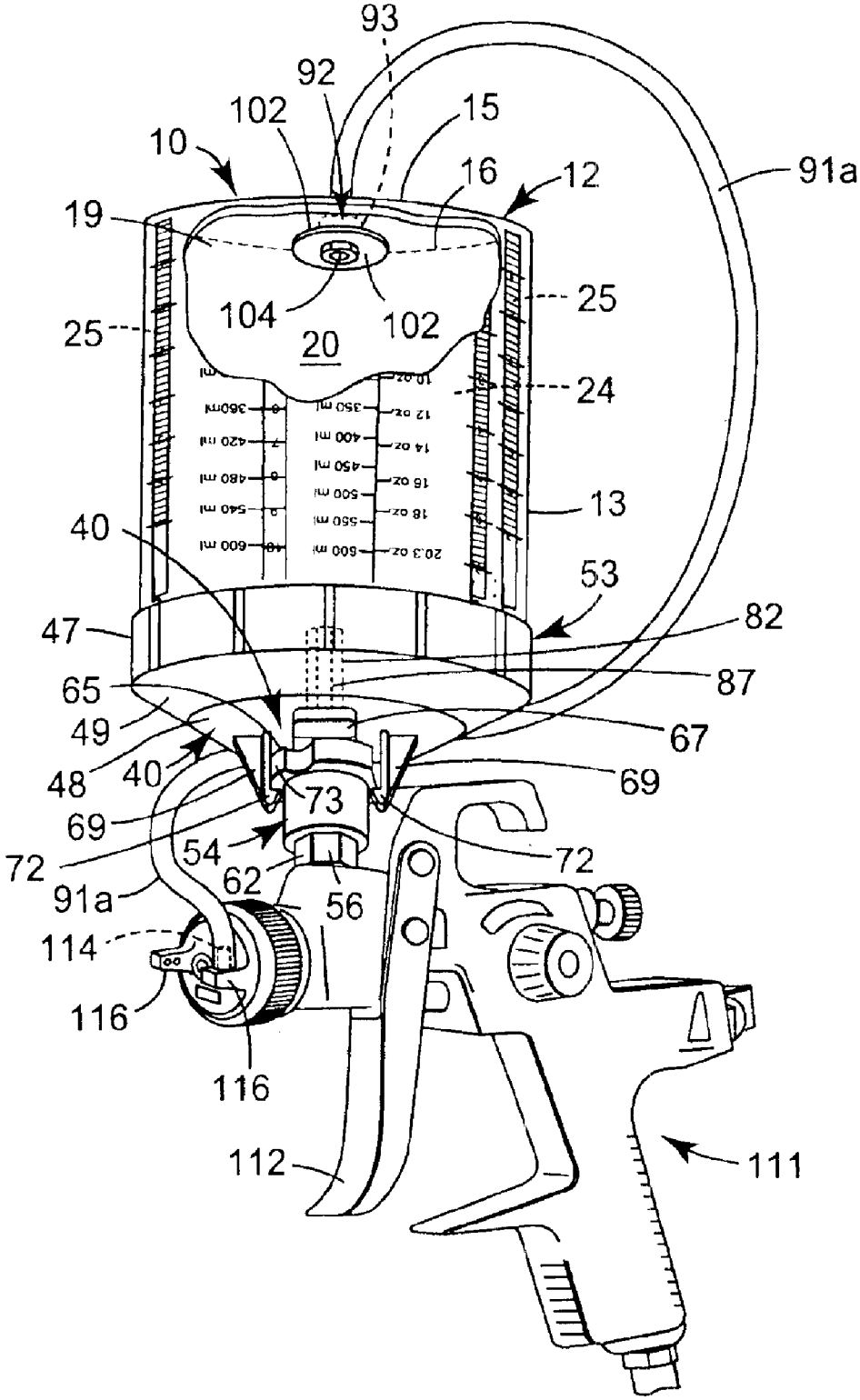
FIG. 3 is a perspective view of the liquid supply assembly according to the present invention, having a part broken away to show detail, shown attached to a modified version of the spraying device or spray gun shown in FIG. 1.

FIG. 3 of the drawing illustrates using the liquid supply assembly 10 according to the present invention to supply liquid to be sprayed to a gravity fed liquid spraying device or spray gun 111 of the type that has an ⅛ inch air pressure outlet nipple 114 attached to and projecting from the normally upper side of one of two air horns 116 flanking the liquid outlet nozzle of the spray gun 111. Air pressure supplied through the nipple 114 is essentially the same as that supplied at through outlet openings in the air horns 116 to shape the spray stream of liquid from the outlet nozzle (e.g., to form an oval, circular or fan shaped spray stream) One spray gun 111 with such an outlet nipple 114 is that commercially designated a "SATA" (t.m.) NR-95" spray gun available from Sata, Farbspritzechnik GmbH & Co., Kornwestheim, Germany, that has been modified using the "HVLP Pro Upgrade" kit commercially available from Lex-Aire Products, Inc., North Billerica, Mass. The liquid supply assembly 10 used on the spray gun 111 has the same parts that are identified by the same reference numerals indicated above with reference to FIGS. 1 and 2, except that the first length of flexible air line 91*a* of the air supply assembly 90 is connected to and receives air pressure from the spray gun 111 through the outlet nipple 114 instead of through the relief valve 95, the air line 91*b*, and the pressure regulator 94 illustrated in FIG. 1. Air pressure is only provided through the nipple 114 and applied between the outer surface of the flexible liner 20 and the inner surface 19 of the container 12 when the spray gun 111 is operated by an operator to spray liquid by manually depressing a trigger 112 on the spray gun 111. When that trigger 112 is released, air pressure between the outer surface of the flexible liner 20 and the inner surface 19 of the container 12 will be vented to atmosphere through the spray gun 111. Thus, if the spray gun 111 is operated by only intermittently pulling the trigger 112 (as is usually done), air pressure above atmospheric pressure will be intermittently applied between the outer surface of the flexible liner 20 and the inner surface 19 of the container 12 when that trigger 112 is pulled, and will be released when the trigger 112 is released. Air pressure received through the outlet nipple 114 when the trigger 112 is pulled has been found to be in the range of about 0.5 to 5 pounds per square inch or 3.5 to 35 kilopascals for the various operating conditions of the spray gun 111 when the pressure in the air line attached to the spray gun 111 was about 45 pounds per square inch or 310 kilopascals. That air pressure between the outer surface of the flexible liner 20 and the inner surface 19 of the container 12 has been found to significantly improve the flow of liquids through the spray gun 111, and allows the spray gun 111 to be used in any orientation, including upside down, even when the liner 20 and container 12 have a capacity of at least 950 milliliters or 32.1 ounces and are filled with liquid, while still maintaining a useful, sustained, generally stable and uniform spray pattern that does not appear to be much diminished or changed from the spray pattern produced when the spray gun 111 is used in its normal upright orientation.

Figure 4:
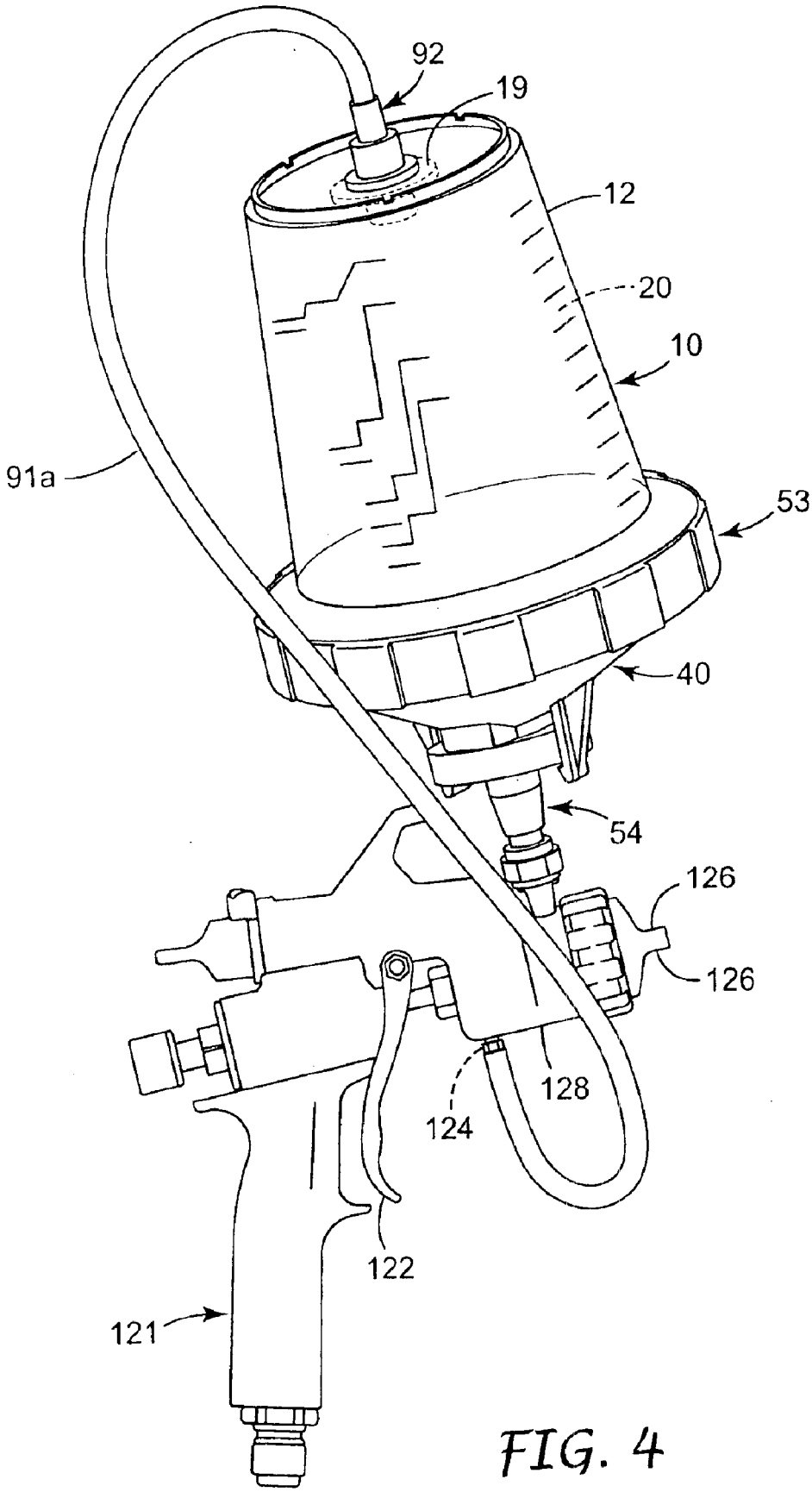
FIG. 4 is a perspective view of the liquid supply assembly according to the present invention, having a part broken away to show detail, shown attached to a turbine powered spraying device that is different than those shown in FIGS. 1 and 3.

FIG. 4 of the drawing illustrates using the liquid supply assembly 10 according to the present invention to supply liquid to be sprayed to the gravity fed liquid spraying device or spray gun 121 supplied with the "GRACO" (t.m.) HVLP 4900 Fine Finish Sprayer that is commercially available from Graco, Inc., Minneapolis, Minn. That HVLP 4900 Fine Finish Sprayer develops air pressure for the spray gun 121 with a portable turbine assembly (not shown). An ⅛ inch air pressure outlet nipple 124 projects from the body of that spray gun 121, and provides a source of air pressure when, and only when, the spray gun 121 is being operated by an operator to spray liquid by manually pulling a trigger 122 on the spray gun 121. Air pressure supplied through the nipple 124 is essentially the same as that supplied at through outlet openings in air horns 126 on the spray gun 121 that shape the spray stream of liquid from an outlet nozzle between the air horns 126. The liquid supply assembly 10 used on the spray gun 121 has the same parts that are identified by the same reference numerals indicated above with reference to FIGS. 1 and 2, except that the first length of flexible air line 91*a* of the air supply assembly 90 is connected to and receives air pressure from the spray gun 121 through the outlet nipple 124 instead of through the relief valve 95, the air line 91*b*, and the pressure regulator 94 illustrated in FIG. 1. In FIG. 4 the liquid supply assembly 10 is illustrated without the indicating sheet 24. Air pressure is only provided through the nipple 124 and applied between the outer surface of the flexible liner 20 and the inner surface 19 of the container 12 when the spray gun 121 is operated by an operator to spray liquid by manually depressing the trigger 122 on the spray gun 121. When that trigger 122 is released, air pressure between the outer surface of the flexible liner 20 and the inner surface 19 of the container 12 will be vented to atmosphere through the spray gun 121. Thus, if the spray gun 121 is operated by only intermittently pulling the trigger 122 (as is usually done), air pressure above atmospheric pressure will be intermittently applied between the outer surface of the flexible liner 20 and the inner surface 19 of the container 12 when that trigger 122 is pulled, and will be released when the trigger 122 is released. Air pressure received through the outlet nipple 114 when the trigger 122 is pulled has been found to be in the range of about 0.5 to 8 pounds per square inch or 3.5 to 55 kilopascals for the various operating conditions of the spray gun 121 (i.e., in the range of about 0.5 to 5 pounds per square inch or 3.5 to 35 kilopascals when the sprayer is operated at a first speed typically used to apply the color phase of automotive paints, and in the range of about 0.5 to 8 pounds per square inch or 3.5 to 55 kilopascals when the sprayer is operated at a second higher speed that is useful for applying higher viscosity primers or some higher viscosity clear coat automotive paint layers). That air pressure between the outer surface of the flexible liner 20 and the inner surface 19 of the container 12 has been found to significantly improve the flow of liquids through the spray gun 121, and allows the spray gun 121 to be used in any orientation, including upside down, or in its normal position with a collar 128 with which the second adapter 54 is engaged rotated 180 degrees from the position illustrated so that the liquid supply assembly 10 hangs below the collar 128, even when the liner 20 and container 12 have a capacity of at least 950 milliliters or 32.1 ounces and are filled with liquid, while still maintaining a useful, sustained, generally stable and uniform spray pattern that does not appear to be much diminished or changed from the spray pattern produced when the spray gun 121 is used in its normal upright orientation and the liquid supply assembly 10 is positioned above the spray gun 121.

We have also modified a "GRACO" (t.m.) Delta HVLP 239-57X spray gun commercially available from Graco, Inc., Minneapolis, Minn., by attaching an ⅛ inch air pressure outlet nipple through the normally upper wall of one of its two air horns flanking the liquid outlet nozzle of the spraying device in the position illustrated for the outlet nipple 114 illustrated on the spray gun 111 of FIG. 3. Air pressure supplied through that nipple was essentially the same as that supplied at through outlet openings in the air horns to shape the spray stream of liquid from the outlet nozzle. A liquid supply assembly 10 of the type described above was attached to that spray gun with the flexible air line 91*a* of the air supply assembly 90 connected to and receiving air pressure from the spray gun through that outlet nipple. Air pressure received through the outlet nipple was found to be in the range of about 0.5 to 5 pounds per square inch or 3.5 to 35 kilopascals for the various operating conditions of the spray gun when the pressure in the air line attached to the spray gun was about 45 pounds per square inch or 310 kilopascals. That air pressure between the outer surface of the flexible liner 20 and the inner surface 19 of the container 12 was found to significantly improve the flow of liquids through the spraying device, and allowed the spraying device to be used in any orientation, including upside down, while still maintaining a useful, sustained, generally stable and uniform spray pattern that did not appear to be much diminished from the spray pattern produced when the spraying device was used in its normal upright orientation.

The present invention has now been described with reference to several embodiments and applications thereof. It will be apparent to those skilled in the art that many changes can be made in the embodiments and applications described without departing from the scope of the present invention. Thus, the scope of the present invention should not be limited to the structures, applications and methods described in this application, but only by the structures, applications and methods described by the language of the claims and the equivalents thereof.

What is claimed is:

1. In combination, a gravity fed liquid spraying device having an inlet port: and a liquid supply assembly comprising:

a container of stiff material comprising a side wall having first and second ends, and an end wall extending across the second end of said side wall, said container having an inner surface defining a cavity in said container, and said first end of said side wall defining an opening into said cavity;

a flexible liner within the cavity in said container, said liner having an outer surface corresponding in shape to the inner surface of said container, an inner surface defining a cavity in said liner, and an annular lip along the first end of said side wall defining an opening into the cavity in said liner;

an adapter assembly comprising a central portion having a through opening and engaging the inlet port of the liquid spraying device, a transverse portion including a peripheral part engaged within said flexible liner adjacent said first end of said container, and means for sealing the flexible liner around said peripheral part of the adapter assembly, said adapter assembly normally positioning said container and said flexible liner above said liquid spraying device; and an air supply assembly connected to said container for supplying air under pressure between the outer surface of said flexible liner and the inner surface of said container.

2. A combination according to claim 1 wherein said air supply assembly includes means for supplying air pressure of less than about 10 pounds per square inch or 69 kilopascals between the outer surface of said flexible liner and the inner surface of said container.

3. A combination according to claim 1 wherein said air supply assembly includes means for supplying air pressures in the range of about 0.5 to 8 pounds per square inch or 3.5 to 55 kilopascals between the outer surface of said flexible liner and the inner surface of said container.

4. A combination according to claim 1 wherein said adapter assembly further includes a filter of less than 125 micrometers across the through opening in said adapter assembly.

5. A combination according to claim 1 wherein said air supply assembly comprises an air inlet connector including a first portion attached to one of said walls of said container and having opening in the cavity of the container, a second portion adapted for engagement with said first portion, means for releasably engaging said first and second portions, and an air line having one end coupled to said second portion and an opposite second end adapted to be engaged with a source of air under pressure.

6. A combination according to claim 1 wherein said air supply assembly is adapted to be connected to an air outlet nipple on the liquid spraying device communicating with a source of air under pressure used to shape a spray stream of liquid from an outlet nozzle on the spraying device.

7. A combination according to claim 1 wherein said air supply assembly comprises a pressure regulator adapted to be engaged with a source of air under pressure.

8. A combination according to claim 1 wherein the cavity in said liner has a capacity of at least 950 milliliters or 32.1 ounces.

9. A method for providing a supply of liquid for a gravity fed liquid spraying device, said method comprising the steps of:

providing a container of stiff material comprising a side wall having first and second ends, and an end wall extending across the second end of the side wall, the container having an inner surface defining a cavity in the container, and the first end of the side wall defining an opening into the cavity;

providing a flexible liner having an outer surface corresponding in shape to the inner surface of the container, an inner surface defining a cavity in the liner, and an annular lip positioned along the first end of the side wall of the container when the outer surface of the liner is along the inner surface of the container, said annular lip defining an opening into the cavity in the liner;

positioning the liner within the cavity in the container;

pouring the liquid into the cavity in the liner;

providing an adapter assembly comprising a central portion having a through opening adapted to engage the inlet port of the gravity fed liquid spraying device, a transverse portion including a peripheral part adapted for engagement within the flexible liner adjacent the first end of the container, and means for sealing the flexible liner around the peripheral part of the adapter assembly;

engaging the adapter assembly with the inlet port of the gravity fed liquid spraying device;

engaging the peripheral part of the adapter assembly within the flexible liner adjacent the top end of the container;

securing the flexible liner around the peripheral part of the adapter assembly; normally positioning the gravity fed liquid spraying device with the container and the flexible liner above the liquid spraying device; and supplying air at a pressure above atmospheric pressure between the outer surface of said flexible liner and the inner surface of said container.

10. A method for providing a supply of liquid for a liquid spraying device according to claim 9 wherein in said supplying step said air is supplied at a pressure of less than about 10 pounds per square inch or 69 kilopascals.

11. A method for providing a supply of liquid for a liquid spraying device according to claim 9 wherein in said supplying step said air is supplied a pressure in the range of about 0.5 to 8 pounds per square inch or 3.5 to 55 kilopascals.

12. A method for providing a supply of liquid for a liquid spraying device according to claim 9 wherein in said supplying step said air is supplied through a pressure regulator.

13. A method for providing a supply of liquid for a liquid spraying device according to claim 9 wherein in said supplying step said air is supplied from a source of air pressure on said spraying device used to shape a spray stream of liquid from an outlet nozzle on the spraying device, which source of air pressure is supplied only when said spraying device is activated to spray liquid.

14. A method for providing a supply of liquid for a liquid spraying device according to claim 9 further including the step of filtering the liquid through a filter of less than about 125 micrometers.

15. A method for providing a supply of liquid for a liquid spraying device according to claim 9 wherein the cavity in said liner has a capacity of at least 950 milliliters or 32.1 ounces.

16. A liquid supply assembly for use with a liquid spraying device, the supply assembly comprising:

a container of stiff material comprising a side wall having top and bottom ends, and a bottom wall extending across the bottom end of said side wall, said container having an inner surface defining a cavity in said container, and said top end of said side wall defining an opening into said cavity;

a flexible liner within the cavity in said container, said liner having an outer surface corresponding in shape to the inner surface of said container, an inner surface defining a cavity in said liner, and an annular lip along the top end of said side wall defining an opening into the cavity in said liner;

an adapter assembly comprising a central portion having a through opening and being adapted to engage the inlet port of a liquid spraying device, a transverse portion including a peripheral part adapted for engagement within said flexible liner adjacent said top end of said container, and means for sealing the flexible liner around said peripheral part of the adapter assembly, said adapter assembly further including a filter of less than 125 micrometers across the through opening in said adapter assembly; and an air supply assembly connected to said container for supplying air under pressure between the outer surface of said flexible liner and the inner surface or said container.

17. A liquid supply assembly for use with a liquid spraying device, the supply assembly comprising:

a container of stiff material comprising a side wall having top and bottom ends, and a bottom wall extending across the bottom end of said side wall, said container having an inner surface defining a cavity in said container, and said top end of said side wall defining an opening into said cavity;

a flexible liner within the cavity in said container, said liner having an outer surface corresponding in shape to the inner surface of said container, an inner surface defining a cavity in said liner, and an annular lip along the top end of said side wall defining an opening into the cavity in said liner;

an adapter assembly comprising a central portion having a through opening and being adapted to engage the inlet port of a liquid spraying device, a transverse portion including a peripheral part adapted for engagement within said flexible liner adjacent said top end of said container, and means for sealing the flexible liner around said peripheral part of the adapter assembly; and an air supply assembly connected to said container for supplying air under pressure between the outer surface of said flexible liner and the inner surface of said container, said air supply assembly comprising an air inlet connector including a first portion attached to the bottom wall of said container and having opening in the cavity of the container, a second portion adapted for engagement with said first portion, means for releasably engaging said first and second portions, and an air line having one end coupled to said second portion and an opposite second end adapted to be engaged with a source of air under pressure.

18. A liquid supply assembly for use with a liquid spraying device, the supply assembly comprising:

a container of stiff material comprising a side wall having top and bottom ends, and a bottom wall extending across the bottom end of said side wall, said container having an inner surface defining a cavity in said container, and said top end of said side wall defining an opening into said cavity;

a flexible liner within the cavity in said container, said liner having an outer surface corresponding in shape to the inner surface of said container, an inner surface defining a cavity in said liner, and an annular lip along the top end of said side wall defining an opening into the cavity in said liner;

an adapter assembly comprising a central portion having a through opening and being adapted to engage the inlet port of a liquid spraying device, a transverse portion including a peripheral part adapted for engagement within said flexible liner adjacent said top end of said container, and means for sealing the flexible liner around said peripheral part of the adapter assembly; and an air supply assembly connected to said container for supplying air under pressure between the outer surface of said flexible liner and the inner surface of said container, said air supply assembly being adapted to be connected to an air outlet nipple on the liquid spraying device communicating with a source of air under pressure used to shape a spray stream of liquid from an outlet nozzle on the spraying device.

19. A method for providing a supply of liquid for a liquid spraying device, said method comprising the steps of:

providing a container of stiff material comprising a side wall having top and bottom ends, and a bottom wall extending across the bottom end of the side wall, the container having an inner surface defining a cavity in the container, and the top end of the side wall defining an opening into the cavity;

providing a flexible liner having an outer surface corresponding in shape to the inner surface of the container, an inner surface defining a cavity in the liner, and an annular lip adapted to be positioned along the top end of the side wall of the container when the outer surface of the liner is along the inner surface of the container, said annular lip defining an opening into the cavity in the liner;

positioning the liner within the cavity in the container;

pouring the liquid into the cavity in the liner;

providing an adapter assembly comprising a central portion having a through opening adapted to engage the inlet port of the liquid spraying device, a transverse portion including a peripheral part adapted for engagement within the flexible liner adjacent the top end of the container, and means for sealing the flexible liner around the peripheral part of the adapter assembly;

engaging the adapter assembly with the inlet port of the liquid spraying device; engaging the peripheral part of the adapter assembly within the flexible liner adjacent the top end of the container;

securing the flexible liner around the peripheral part of the adapter assembly; and supplying air at a pressure above atmospheric pressure between the outer surface of said flexible liner and the inner surface of said container, said air being supplied from a source of air pressure on said spraying device used to shape a spray stream of liquid from an outlet nozzle on the spraying device, which source of air pressure is supplied only when said spraying device is activated to spray liquid.

* * * * *

UNITED STATES PATENT AND TRADEMARK OFFICE

CERTIFICATE OF CORRECTION

PATENT NO. : 6,953,155 B2
APPLICATION NO. : 10/279518
DATED : October 11, 2005
INVENTOR(S) : Joseph, Stephen C. P.

It is certified that error appears in the above-identified patent and that said Letters Patent is hereby corrected as shown below:

Column 11
Line 21, after "port" delete ":" and insert --;--

Column 12
Line 60, after "supplied" insert --at--

Column 13
Line 41, delete "or" and insert --of--

Signed and Sealed this

First Day of August, 2006

JON W. DUDAS
*Director of the United States Patent and Trademark Office*